US005172099A

United States Patent [19]

Glaser

[11] Patent Number: 5,172,099

[45] Date of Patent: Dec. 15, 1992

[54] SELF MONITORING FIRE DETECTION SYSTEM

[75] Inventor: Robert E. Glaser, Wilson, N.C.

[73] Assignee: Walter Kidde Aerospace Inc., Wilson, N.C.

[21] Appl. No.: 808,981

[22] Filed: Dec. 17, 1991

Related U.S. Application Data

[63] Continuation of Ser. No. 524,303, May 15, 1990, abandoned.

[51] Int. Cl.[5] ..... G08B 17/06

[52] U.S. Cl. ..... 340/577; 340/596; 340/587; 340/599; 338/26

[58] Field of Search ..... 340/587, 596, 599

[56] References Cited

U.S. PATENT DOCUMENTS

| | | | |
|---|---|---|---|
| 2,028,653 | 1/1936 | Ekman | 340/508 |
| 3,380,045 | 4/1968 | Lindberg | 340/508 |
| 4,149,159 | 4/1979 | Dätwyler et al. | 340/587 |
| 4,684,790 | 8/1987 | Greenhalgh | 340/629 |

FOREIGN PATENT DOCUMENTS

| | | | |
|---|---|---|---|
| 0211173 | 1/1957 | Australia | 340/596 |
| 0079853 | 4/1949 | Denmark | 340/599 |

*Primary Examiner*—Edward L. Coles, Sr.
*Assistant Examiner*—Jill Jackson
*Attorney, Agent, or Firm*—Darby & Darby

[57] ABSTRACT

Disclosed is a fire detection and engine monitoring system of the type which utilizes a pair of elongated thermistor strands extending over substantially the same path to provide redundancy. A resistance of the two thermistor strands are sensed and a resistance difference signal is generated. The resistance signal is monitored for abnormal differences between the two identical thermistor devices which are essentially exposed to the same operation conditions. Such differences are indicative of the deterioration over time of the condition of one of the sensors.

2 Claims, 2 Drawing Sheets

SELF MONITORING FIRE DETECTION SYSTEM

This is a continuation of application Ser. No. 524,303, filed May 15, 1990 now abandoned.

FIELD OF THE INVENTION

The present invention relates generally to alarm systems and, more particularly, concerns a fire alarm and engine monitoring system of a type useful, for example, on board aircraft.

BACKGROUND OF THE INVENTION

Aircraft fire detectors conventionally utilize elongated, distributed thermistor elements which extend through the aircraft for temperature monitoring purposes. Such a thermistor element typically comprises a small diameter tube filled with a thermistor material in which is embedded a wire running the full length of the interior of the tube. Such thermistors exhibit a resistance characteristic between the tube and the wire which decreases with increasing temperature. By design, a fire occurring at any point along the distributed thermistor will cause a substantial reduction in the resistance measured between the wire and the tube at either end of the thermistor, and this reduction in resistance can be utilized to detect and signal the occurrence of a fire, followed by automatic shut down of the aircraft engine and other systems.

False alarms have always been a significant concern in such systems, not only because of the in-flight shut down resulting from a false fire warning, but also because aircraft equipment indicating a fire warning must be removed from service, and substantial delays are encountered in testing the equipment before it can be restored to service.

In order to cope with the problem of false fire alarm indications, such fire detection systems have utilized two thermistors over the same path, thereby introducing redundancy. By requiring the same alarm condition to exist on both thermistors before an alarm is issued to the cockpit crew, such redundant systems reduce the incidence of false alarms. With this type of system, the defective thermistor loop may be shut down, and the aircraft may be dispatched with only a single loop operative. However, whenever such single loop dispatch is implemented, the risk of a false warning occurring is substantially increased.

It is therefore an object of the present invention to minimize or eliminate the occurrence of false fire alarms in aircraft fire detecting systems and to minimize or eliminate the incidence of single loop fire detection system operation.

In accordance with the present invention, the resistance measurements performed on the redundant thermistor loops are differentially monitored for abnormal differences between the two identical thermistor devices which are essentially exposed to the same operating conditions. Such differences can be an indication of deterioration of the condition of one of the sensors. Since it normally takes many hours, if not days, weeks or months for the deterioration to reach the alarm level, the present invention provides a very early indication of impending failure. By displaying signals regarding this deterioration to maintenance personnel, it becomes possible to fix the problem before a failure ever occurs.

BRIEF DESCRIPTION OF THE DRAWINGS

The foregoing brief description, as well as further objects, features, and advantages of the present invention will be understood more completely from the following detailed description of a presently preferred embodiment of the invention, with reference being had to the accompanying drawings in which.

DETAILED DESCRIPTION OF THE PREFERRED EMBODIMENT

Figure 1:
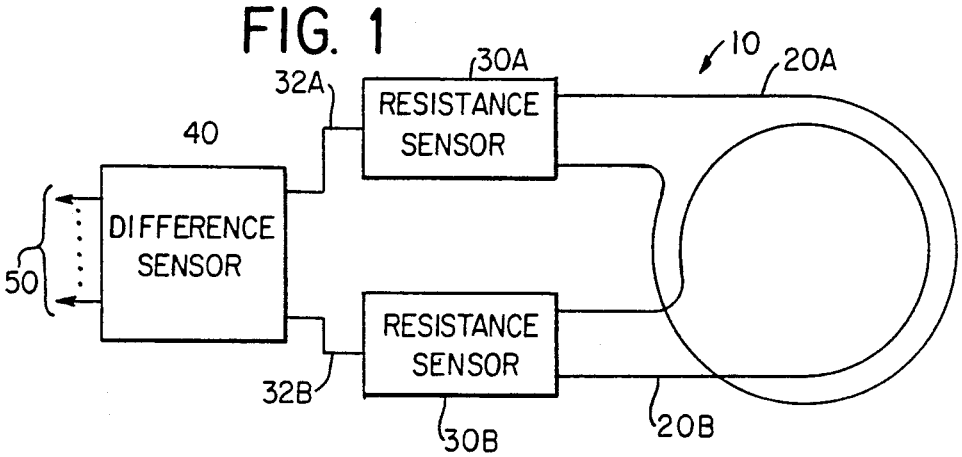
FIG. 1 is a functional block diagram illustrating a preferred embodiment of a fire detection and engine monitoring system in accordance with the present invention.

Referring now to FIG. 1, there is illustrated an aircraft fire alarm system 10 embodying objects and features of the present invention. This system includes identical distributed thermistor elements 20A and 20B, which are routed in parallel over the same path. The resistances of the respective thermistors 20A and 20B are sensed by corresponding resistance sensors 30A and 30B. These resistance sensors produce signals on leads 32A and 32B, respectively, indicative of the resistance measurement of the corresponding resistance sensor. A difference sensor 40 processes the signals appearing on leads 32A and 32B, to produce signals representing these differences on leads indicated collectively as 50. Various monitored signals and alarms are produced.

Figure 2:
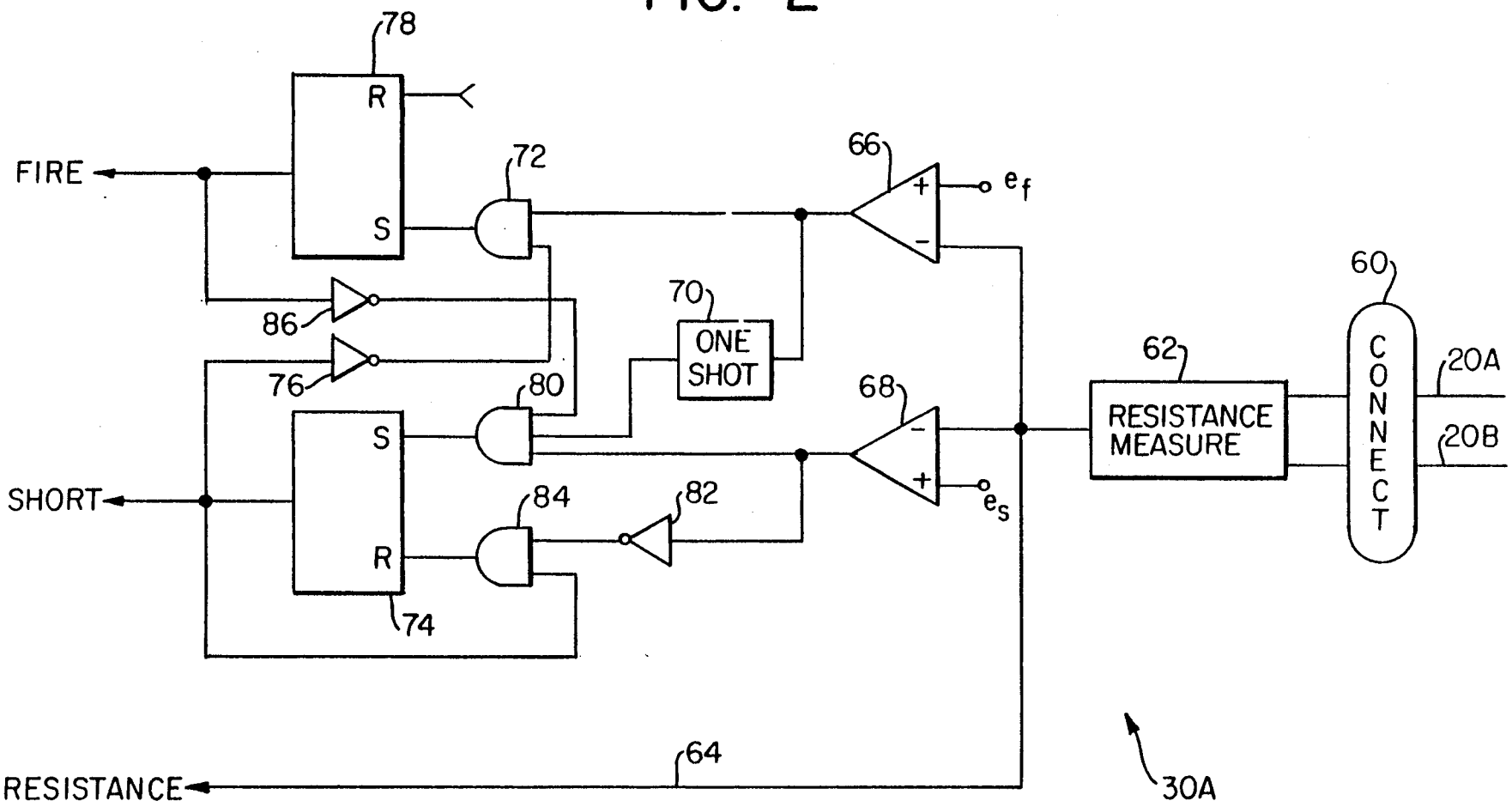
FIG. 2 is a circuit schematic diagram of resistance sensor 30A of FIG. 1.

FIG. 2 is a circuit schematic diagram of resistance sensor 30A of FIG. 1. Resistance sensor 30B is identical, and will therefore not be described separately. Both ends of distributed thermistor 20A are received in a connector element 60. This element has means, for example, switches, which permit disconnecting either or both ends of the thermistor from the elements which follow, all for connecting either end of the thermistor to ground for testing purposes. Connector 60 connects the thermistor 20A across a conventional resistance measuring device 62. Preferably, this device measures the resistance of the thermistor from both ends, so that operation can continue, should a discontinuity develop in thermistor 20A. Should a short circuit develop at any point along the thermistor, this technique of measurement will also locate the short circuit quickly by comparing the values of the two resistance measurements. The output of device 62 is either the average of the two measurements (if the thermistor is intact), or the sum of the two measurements (if the thermistor has a discontinuity). In either case, the output of device 62 is indicative of the resistance of the thermistor 20A. The output of device 62 is provided on lead 64 and to the inverting inputs of comparators 66 and 68. Comparator 66 receives a reference voltage $e_f$, which corresponds to a resistance threshold indicating a fire situation, and comparator 68 receives a reference voltage $e_s$ which corresponds to a resistance threshold indicating the existence of a short circuit on the thermistor.

The output of comparator 66 is applied to a one-shot 70 and to one input of a two input AND gate 72, the other input to which is provided from the output of a set/reset flip-flop 74 through an inverter 76. The output of AND gate 72 is applied to the set input of a set/reset flip-flop 78, the output of which provides the fire alarm signal.

The output of comparator 68 is applied to a three input AND gate 80 and, through an inverter 82 to a two input AND gate 84. The other inputs to AND gate 80 are provided by one-shot 70 and from the output of flip-flop 78 through inverter 86. The output of AND gate 80 is connected to the set input of flip-flop 74. The second input to AND gate 84 is provided from the output of flip-flop 74.

In operation, the resistance measurement will drop instantaneously below $e_s$ when a short circuit occurs. Since $e_s$ is lower than $e_f$, the outputs of both inverters 66 and 68 will therefore go high instantaneously when a short circuit occurs. On the other hand, when a fire alarm situation occurs, the resistance measurement will decrease over several milliseconds, until it drops below $e_f$. It may or may not drop below $e_s$, but if it does, it will again do so gradually.

It will therefore be appreciated that when a short circuit occurs in the thermistor, the outputs of both comparators 66 and 68 go high simultaneously, one-shot 70 will be activated by the output of comparator 66. This one-shot is designed to produce a relatively narrow pulse, which will be present when the output of comparator 68 is high, only during the occurrences a short circuit on thermistor 20A. If a fire alarm condition is not present at the output of flip-flop 78, the output of AND gate 80 will then go high and cause flip-flop 74 to go into a set condition, indicating a short circuit alarm situation. Through inverter 76, this alarm prevents flip-flop 78 from being set, so that a fire alarm will not be produced. As soon as the output of comparator 68 goes low (indicating that the short circuit has disappeared) the output of AND gate 84 will go high and flip-flop 74 will be reset, removing the short circuit alarm. This will present a high input to AND gate 72 through inverter 76. Under these circumstances, should the output of comparator 66 go high, indicating a fire alarm condition, the output of AND gate 72 will go high, and flip-flop 78 will be set, indicating a fire alarm condition on its output. The output of flip-flip 78 is applied through invertor 86 to disable AND gate 80, so that flip-flop 74 will not be able to produce a short circuit alarm.

Figure 3:
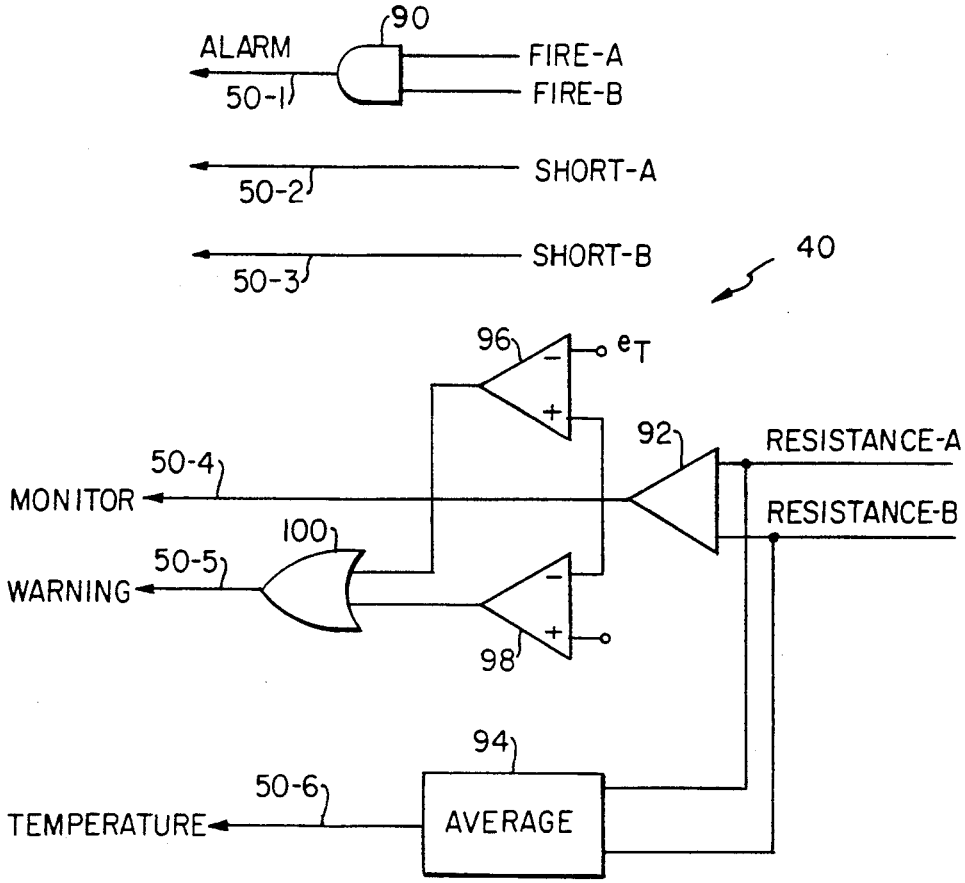
FIG. 3 is a circuit schematic diagram of difference sensor 40 of FIG. 1.

FIG. 3 is a circuit schematic diagram of difference sensor 40. This difference sensor receives the fire, short, and resistance signals from resistance sensors 30A and 30B and produces a plurality of status signals on leads 50. For example, the fire alarm signals from sensors 30A and 30B are applied to an AND gate 90, and the output of the AND gate provides a fire alarm signal on lead 50-1. It will be appreciated that a fire alarm will occur only if both resistance sensors indicate a fire condition.

The short circuit signals resistance of sensors 30A and 30B are provided on leads 50-2 and 50-3 and may be utilized, for example to operate some form of display element. An operator would then be in a position to disconnect the thermistor that indicated a short circuit condition.

The resistance signals from sensors 30A and 30B are applied to a differential amplifier 92 and an averaging circuit 94. The differential amplifier 92 produces a monitor signal on lead 50-4 which is equal to the difference between the two resistance measurements. This signal may be monitored in order to obtain an indication of the relative reliability of the thermistors. After an initial calibration, with both thermistors operating properly, the monitor signal should indicate a relatively small value. This signal can be monitored on a regular basis, or even recorded and its gradual increase in magnitude will indicate a deterioration of one of the thermistors. The monitor signal is also applied to pair of comparators 96, 98. Comparator 96 produces a positive signal when the signal of the operative amplifier 92 exceeds $e_T$, and comparator 98 produces a positive output signal when the output of amplifier 92 is below $-e_T$. The outputs of these two comparators are applied to an OR gate 100 which produces a logical one output when the signal at the output of amplifier 92 is not in the range of $-e_T$ to $e_T$. The value $e_T$ is defined so that the output of OR gate 100 on lead 50-5 will serve as a warning signal, indicating the difference between the two resistance measurements has become excessive.

Averaging circuit 94 produces a temperature signal on lead 50-6 which corresponds to the average between the two resistance measurements. This temperature signal may be applied to an appropriate device for display or to a recorder. A practical application would be to monitor engine operating temperature and therefore its condition.

In summary, the differential processing of the two resistance signals makes it possible to monitor the distributed thermistors, in order to observe long term variations that may be indicative of impending failure. Maintenance may therefore be performed at a convenient time rather than having to take the aircraft out of service unexpectedly or to operate it on single loop dispatch.

Although preferred forms of the invention have been disclosed for illustrative purposes, those skilled in the art will appreciate that many additions, modifications, and substitutions are possible without departing from the scope and spirit and of the invention as defined in the accompanying claims.

What is claimed is:

1. A fire detection and monitoring system comprising:

first and second elongated thermistor means extending over substantially the same predefined path in an area to be monitored so as to be exposed to the same operating conditions, the resistance of each of said first and second thermistor means varying substantially identically with temperature;

first sensing means sensing the resistance of said first thermistor for producing a first resistance signal representative of said resistance of said first thermistor;

second sensing means sensing the resistance of said second thermistor for producing a second resistance signal representative of said resistance of said second thermistor;

third sensing means differentially responsive to said first and second resistance signals for producing a resistance difference signal; and means responsive to said third sensing means for indicating when said resistance difference signal exceeds a predefined value corresponding to an abnormality in operation of one of said thermistors.

2. A method of operating a fire detection and monitoring system of the type utilizing a pair of elongated thermistor devices extending over substantially the same path in an area to be monitored and first and second resistance sensing means, each dedicated to sensing the resistance of one of said thermistors, wherein the resistance of each of said thermistor devices of said pair of thermistor devices varies substantially identically with temperature so that the fire having increased temperature can be detected, said method comprising the steps of:

arranging said thermistors so that they are exposed to the same operating conditions and differentially processing the resistances sensed by said first and second resistance sensing means to produce a resistance difference signal; and sensing when said resistance difference signal exceeds a predetermined value corresponding to an abnormality in operation of one of said thermistor devices.

* * * * *